US010920684B2

(12) United States Patent
Bell et al.

(10) Patent No.: US 10,920,684 B2
(45) Date of Patent: Feb. 16, 2021

(54) ELECTRONIC FUEL INJECTION THROTTLE BODY ASSEMBLY

(71) Applicant: Holley Performance Products, Inc., Bowling Green, KY (US)

(72) Inventors: Robert M. Bell, Bowling Green, KY (US); Barry Taylor, Franklin, KY (US)

(73) Assignee: Holley Performance Products, Inc., Bowling Green, KY (US)

( * ) Notice: Subject to any disclaimer, the term of this patent is extended or adjusted under 35 U.S.C. 154(b) by 0 days.

(21) Appl. No.: 16/405,519

(22) Filed: May 7, 2019

(65) Prior Publication Data

US 2019/0345883 A1 Nov. 14, 2019

Related U.S. Application Data

(60) Provisional application No. 62/669,094, filed on May 9, 2018.

(51) Int. Cl.

| | |
|---|---|
| ***F02M 55/02*** | (2006.01) |
| ***F02M 61/14*** | (2006.01) |
| ***F02D 35/00*** | (2006.01) |
| ***F02D 41/30*** | (2006.01) |
| ***F02D 41/00*** | (2006.01) |

(52) U.S. Cl.

CPC ..... *F02D 35/0053* (2013.01); *F02D 35/0084* (2013.01); *F02D 41/009* (2013.01); *F02D 41/30* (2013.01); *F02M 55/02* (2013.01); *F02M 61/145* (2013.01); *F02D 35/0092* (2013.01)

(58) Field of Classification Search

CPC . F02D 35/0084; F02D 35/0092; F02M 55/02; F02M 61/145

USPC ..... 123/337, 468, 469, 472

See application file for complete search history.

(56) References Cited

U.S. PATENT DOCUMENTS

| | | | |
|---|---|---|---|
| 4,224,908 | A | 9/1980 | Bier et al. |
| 4,230,645 | A | 10/1980 | Dodson |
| 4,246,875 | A | 1/1981 | Bier et al. |
| 4,294,282 | A | 10/1981 | McCabe et al. |
| 4,306,441 | A | 12/1981 | Dodson |
| 4,318,214 | A | 3/1982 | Dodson |
| 4,325,339 | A | 4/1982 | Bier et al. |
| 4,357,283 | A | 11/1982 | Manning |
| 4,434,762 | A | 3/1984 | McCabe |
| 4,434,763 | A | 3/1984 | McCabe et al. |

(Continued)

FOREIGN PATENT DOCUMENTS

| | | |
|---|---|---|
| AU | 339157 | 10/2011 |
| AU | 341133 | 2/2012 |

(Continued)

OTHER PUBLICATIONS

U.S. Appl. No. 16/404,308 entitled "Electronic Fuel Injection Throttle Body Assembly" filed May 6, 2019.

(Continued)

*Primary Examiner* — Erick R Solis

(74) *Attorney, Agent, or Firm* — Middleton Reutlinger

(57) ABSTRACT

Present embodiments provide a throttle body which may be used with a variety of engines of different manufacturers. The throttle body includes an inlet which expands to two or more bores, which extend downwardly through the throttle body. The throttle body may provide improved fuel pathways and fuel injector placement.

16 Claims, 10 Drawing Sheets

(56) References Cited

U.S. PATENT DOCUMENTS

| | | | | |
|---|---|---|---|---|
| 4,556,032 | A | 12/1985 | Miller | |
| 4,949,983 | A | 8/1990 | Miller | |
| 5,261,382 | A | 11/1993 | Nikolai | |
| D447,147 | S | 8/2001 | Grant | |
| 6,481,698 | B1 | 11/2002 | Calvin et al. | |
| D508,496 | S | 8/2005 | Grant | |
| D543,555 | S | 5/2007 | Braswell et al. | |
| D555,668 | S | 11/2007 | Benoit | |
| D578,550 | S | 10/2008 | Benoit | |
| 7,533,661 | B2 | 5/2009 | Baasch | |
| 7,591,245 | B2 | 9/2009 | Baasch et al. | |
| D645,058 | S | 9/2011 | Benoit | |
| D648,746 | S | 11/2011 | Tipton et al. | |
| D655,311 | S | 3/2012 | Gieske et al. | |
| D659,714 | S | 5/2012 | Gieske et al. | |
| D721,389 | S | 1/2015 | Gieske et al. | |
| 9,115,671 | B2 * | 8/2015 | Benoit | F02M 17/34 |
| 9,303,578 | B2 | 4/2016 | Wittkopf et al. | |
| 9,376,997 | B1 | 6/2016 | Farrell et al. | |
| D760,804 | S | 7/2016 | Shehan et al. | |
| 9,482,198 | B1 | 11/2016 | Farrell et al. | |
| 9,845,740 | B2 * | 12/2017 | Wittkopf | F02M 35/10216 |
| D808,435 | S | 1/2018 | Shehan et al. | |
| D810,142 | S | 2/2018 | Shehan et al. | |
| 10,012,197 | B2 | 7/2018 | Flynn et al. | |
| D826,280 | S | 8/2018 | Koo et al. | |
| 10,094,353 | B2 | 10/2018 | Bennett et al. | |
| 2008/0230034 | A1 | 9/2008 | Dunn | |
| 2009/0013955 | A1 | 1/2009 | Sheridan et al. | |
| 2009/0145406 | A1 | 6/2009 | Farrell | |
| 2013/0054121 | A1 | 2/2013 | Casoni et al. | |
| 2013/0298871 | A1 | 11/2013 | Bennett et al. | |
| 2015/0108256 | A1 | 4/2015 | Flynn et al. | |
| 2017/0198672 | A1 | 7/2017 | Farrell et al. | |
| 2018/0119656 | A1 | 5/2018 | Shehan et al. | |

FOREIGN PATENT DOCUMENTS

| | | |
|---|---|---|
| AU | 348732 | 5/2013 |
| AU | 348733 | 5/2013 |
| AU | 348734 | 5/2013 |
| AU | 356762 | 8/2014 |
| AU | 201710470 | 2/2017 |
| AU | 201710471 | 2/2017 |
| AU | 2013254906 | 11/2017 |
| AU | 201813353 | 8/2018 |
| AU | 201813355 | 8/2018 |
| AU | 201815034 | 9/2018 |
| AU | 201815036 | 9/2018 |
| AU | 201816623 | 12/2018 |
| AU | 201816624 | 12/2018 |
| CN | 101568711 | 4/2013 |
| EM | 003729599 | 1/2017 |
| WO | 2019217436 | 11/2019 |

OTHER PUBLICATIONS

U.S. Appl. No. 29/688,819 entitled "Electronic Fuel Injection Throttle Body" filed Apr. 24, 2019.
U.S. Appl. No. 29/693,670 entitled "EFI Throttle Body" filed Jun. 4, 2019.
U.S. Appl. No. 29/695,154 entitled "EFI Throttle Body" filed Jun. 17, 2019.
U.S. Appl. No. 29/696,092 entitled "Electronic Fuel Injection Throttle Body" filed Jun. 25, 2019.
International Search Report and Written Opinion for PCT/US2019/030909 dated Aug. 20, 2019.
International Search Report and Written Opinion for PCT/US2019/031138 dated Aug. 27, 2019.
Youtube video, "Holley Terminator EFI Kit Electronic Fuel Injection", May 6, 2015, retrieved on Jul. 1, 2019. Retrieved from https://www.youtube.com/watch?v=hrTppUkNAn0.
U.S. Appl. No. 29/628,392 entitled "EFI Throttle Body" filed Dec. 4, 2017.
Holley Performance Products, Inc., 2017 New & Hot Products Catalogue—Carburetors, Nov. 1, 2016.
U.S. Appl. No. 62/594,526 entitled "Electronic Fuel Injection Throttle Body Assembly" filed Dec. 4, 2017.
Australian Patent Application No. 2017251869 entitled "Electronic Fuel Injection Throttle Body Assembly" filed Oct. 30, 2017.
U.S. Appl. No. 62/594,527 entitled "Electronic Fuel Injection Throttle Body Assembly" filed Dec. 4, 2017.
U.S. Appl. No. 29/628,394 entitled "EFI Throttle Body" filed Dec. 4, 2017.
U.S. Appl. No. 62/669,052 entitled "Electronic Fuel Injection Throttle Body Assembly" filed May 9, 2018.
U.S. Appl. No. 15/986,571 entitled "Fuel Injection Throttle Body" filed May 22, 2018.
U.S. Appl. No. 16/208,246 entitled "Electronic Fuel Injection Throttle Body Assembly" filed Dec. 3, 2018.
U.S. Appl. No. 29/647,060 entitled "Electronic Fuel Injection Throttle Body" filed May 9, 2018.
U.S. Appl. No. 62/669,094 entitled "Electronic Fuel Injection Throttle Body Assembly" filed May 9, 2018.
U.S. Appl. No. 62/726,723 entitled "Electronic Fuel Injection Throttle Body Assembly" filed Sep. 4, 2018.
Mopar Performance P5249686 Jeep MPI-Fuel, Sep. 2, 2016.
Howell EFI Fuel Injection Conversion Kit, JP258, Apr. 29, 2015.
F.A.S.T. EZ-EFI Self-Tuning Fuel Injection Systems 30294-Kit TBI Converstion Kit, Jun. 30, 2015.
U.S. Appl. No. 16/208,231 entitled "Electronic Fuel Injection Throttle Body Assembly" filed Dec. 3, 2018.
International Search Report and Written Opinion for PCT/US2018/063660 dated Mar. 20, 2019.
International Search Report and Written Opinion for PCT/US2018/063668 dated Mar. 20, 2019.
Canadian Design Patent Application No. 184483 entitled "Electronic Fuel Injection Throttle Body" filed Oct. 31, 2018.
Canadian Design Patent Application No. 184482 entitled "Electronic Fuel Injection Throttle Body" filed Oct. 31, 2018.
Mexican Design Patent Application No. MX/f/2018/003332 entitled "Electronic Fuel Injection Throttle Body" filed Nov. 8, 2018.
Mexican Design Patent Application No. MX/f/2018/003333 entitled "Electronic Fuel Injection Throttle Body" filed Nov. 8, 2018.
U.S. Appl. No. 29/647,068 entitled "Electronic Fuel Injection Throttle Body" filed May 9, 2018.
Wikipedia, Quadrajet, Rochester Products spread bore carburetor introduced in 1964, retrieved from internet on Apr. 16, 2019.
Australian Patent Application No. 2019267570 titled "Electronic Fuel Injection Throttle Body Assembly" entered national stage Nov. 5, 2020.
The International Bureau of WIPO: International Preliminary Report on Written Opinion for PCT/US2019/031138 dated Nov. 10, 2020.

* cited by examiner

ELECTRONIC FUEL INJECTION THROTTLE BODY ASSEMBLY

CLAIM TO PRIORITY

This non-provisional patent application claims priority to and benefit of, under 35 U.S.C. § 119(e), U.S. Provisional Patent Application Ser. No. 62/669,094, filed May 9, 2018 and titled "Electronic Fuel Injection Throttle Body Assembly", all of which is incorporated by reference herein.

BACKGROUND

Field of the Invention

Present embodiments relate to throttle body fuel injection systems. More specifically, present embodiments relate to retrofitting carbureted engines with electronic fuel injection (EFI) which may be mounted on a manifold of an internal combustion engine.

Description of the Related Art

Prior art carburetors are often fully mechanical or hydraulic which over time can lead to decrease in proper function. Further, variations in atmospheric temperature and pressure, engine temperature, load and speed are all variable rendering difficult to maximize efficiency and/or performance of prior art carburation. For example, cold engine condition, an engine at idle, and an engine at wide-open throttle all require a rich fuel-air mixture. However, warm engine at cruise requires a lean fuel-air mixture. The airflow also varies greatly, as much as 100 times, between wide-open throttle and idle condition. Still another variable may be fuel formulations and characteristics.

Replacement throttle body systems may be utilized to provide carburetor replacement. However it would be desirable to provide the improved performance of electronic fuel injection. This is especially true for higher performance engines or improving performance and consistency of older engines.

However, when installing these systems, there are multiple variables related to size of throttle body, space on the engine and relative to the vehicle hood, space relative to surrounding engine components.

It would be desirable to improve consistency of operation of an engine throttle body to improve carburetion while also improving performance and/or efficiency. It may also be desirable to provide a throttle body which may be used as a replacement for a carburetor but which is adapted to function with electronic fuel injection. It may also be desirable in some instances for the engine throttle body to aesthetically resemble the carburetor it is replacing, for example with the fittings in similar locations and the like.

The information included in this Background section of the specification, including any references cited herein and any description or discussion thereof, is included for technical reference purposes only and is not to be regarded subject matter by which the scope of the invention is to be bound.

SUMMARY

Embodiments relate to carburetor retrofit fuel injection systems.

Present embodiments provide a throttle body assembly which may be used with a variety of engines of different manufacturers. The throttle body assembly may be used to replace mechanical or hydraulically controlled carburetors with electronic fuel injection. The throttle body assembly may provide improved fuel pathways through the throttle body. The throttle bodies may have improved configuration of the fuel injectors. Further, the throttle body may have computer mounted on the throttle body.

According to some embodiments, an electronic fuel injection throttle body assembly comprises a throttle body having an upper inlet and a lower outlet configured to mount to an internal combustion engine. The upper inlet may have a single cavity which opens into two bores extending through the throttle body. The bores together may define the lower outlet. A fuel component cover may be located on a first side of the throttle body and an electronic control unit cover located on a second side of the throttle body. A first fuel injector and a second fuel injector disposed at least partially within the throttle body. The at least one fuel injector is parallel to a mounting base of the throttle body. A fuel component cover may be connected to the throttle body and have at least one fuel passage in fluid communication with the first and second fuel injectors. At least one connecting fuel passage extending from a fuel inlet passage, comprising a cross-channel and a vertical passageway at least partially disposed within the fuel component cover, wherein the vertical passageway is in fluid communication with the at least one fuel injector. A throttle shaft may extend through the first and second bores of the throttle body. The throttle shaft may be perpendicular to a horizontal direction between a first end and a second end of the at least one injector. The at least one fuel injector may direct fuel into a channel formed at least in part by at least one fuel distribution ring, the at least one fuel distribution ring having a plurality of fuel apertures directing fuel into a bore of said throttle body.

The following optional embodiments, may be utilized with the preceding embodiment either individually or in combination. The inlet may expand from a first size to a larger second size where the bores are positioned. The throttle body assembly may further comprise a wall in the single cavity dividing the first and second bores. The wall may be centered or un-centered within the single cavity. The bores may be of a same diameter or of a differing diameter. The throttle body assembly may further comprise an air filter mount extending from near the inlet. The throttle body assembly may further comprise a throttle lever connected to the throttle shaft. Movement of the throttle lever opens at least one valve plate within each of the bores. The electronic control unit cover may be disposed on an opposite side from the fuel component cover. The fuel component cover may include an inlet and an outlet. The throttle body assembly may further comprise a pressure regulator on the fuel component cover. The pressure regulator where the electronic control unit is in electrical communication with the at least one fuel injector. The fuel injectors are disposed between the fuel component cover and the throttle body. The fuel injectors in fluid communication with a fuel distribution ring on an interior of the bores.

According to some embodiments, a method of delivering fuel and air to a combustion engine manifold comprises pumping fuel to an inlet of an electronic fuel injection throttle body, moving the fuel through a fuel component cover through a fuel passage in communication with first and second fuel injectors, injecting fuel through the fuel injectors into first and second bores, directing airflow through a single inlet of the throttle body, directing airflow through first and second bores in flow communication with said single inlet and, mixing the airflow and the fuel within the bores.

All of the above outlined features are to be understood as exemplary only and many more features and objectives of a throttle body fuel injection system or assembly may be gleaned from the disclosure herein. Therefore, no limiting interpretation of this summary is to be understood without further reading of the entire specification, claims and drawings, included herewith.

BRIEF DESCRIPTION OF THE DRAWINGS

In order that the embodiments may be better understood, embodiments of the throttle body fuel injection system will now be described by way of examples. These embodiments are not to limit the scope of the claims as other embodiments of the throttle body fuel injection system will become apparent to one having ordinary skill in the art upon reading the instant description. Non-limiting examples of the present embodiments are shown in figures wherein:

DETAILED DESCRIPTION

Figure 1:
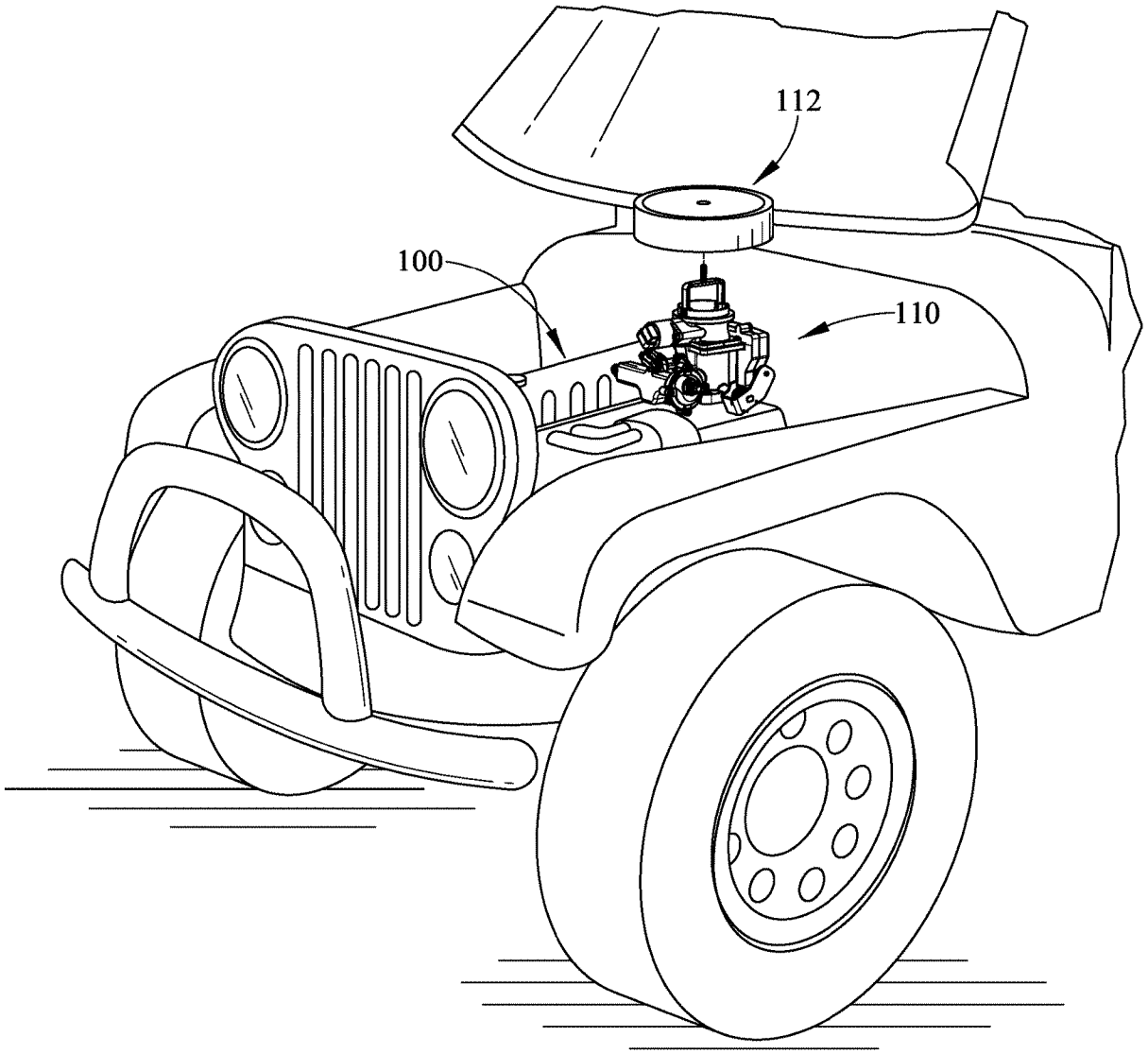
FIG. 1 is a perspective view of a combustion engine with an electronic fuel injection throttle body assembly.

It is to be understood that the electronic fuel injection throttle body assembly is not limited in its application to the details of construction and the arrangement of components set forth in the following description or illustrated in the drawings. The throttle body assembly is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

Referring now in detail to the drawings, wherein like numerals indicate like elements throughout several views, there are shown in FIGS. 1-10 various embodiments of an electronic fuel injection throttle body assembly. Present embodiments pertain to an electronic fuel injection throttle body assembly which may be used to replace or retrofit carburetor systems with an electronic fuel injection.

With reference to FIG. 1, a partial perspective view of an engine compartment is depicted wherein a combustion engine 100 is provided with an electronic fuel injection (EFI) throttle body assembly 110 and an air filter 112. The engine is illustrative as one or more throttle body assemblies 110 may be utilized and one or more filter configurations may be used to deliver air to the one or more throttle body assemblies 110. The combustion process, as one of skill in the art will be aware, combines fuel and air with an ignition source. The instant throttle body assembly 110 is mounted to the engine 100 such as at the manifold and receives air through the air filter 112 and receives fuel from a fuel tank and mixes the two for the ignition which occurs the engine 100. In other embodiments, the assembly 110 may be mounted to the engine indirectly such as to a supercharger.

The EFI throttle body assembly 110 is configured to be compact allowing use in a variety of configurations. Due to the wide variety of engine manufactures and vehicle types and sizes, it is desirable to provide a structure which may be used in many of these vehicles/engines. This also requires consideration of space relative to the engine hood and space relative to surrounding engine components. It may also be desirable to provide a device of minimal height, for example less than about 5 inches, a forward to rear length of about 13 inches and a side to side length of about 9 inches. These dimensions are merely illustrative of a non-limiting embodiment, but provide a compact design desirable for use across many engine sizes and vehicle types.

Figure 2:
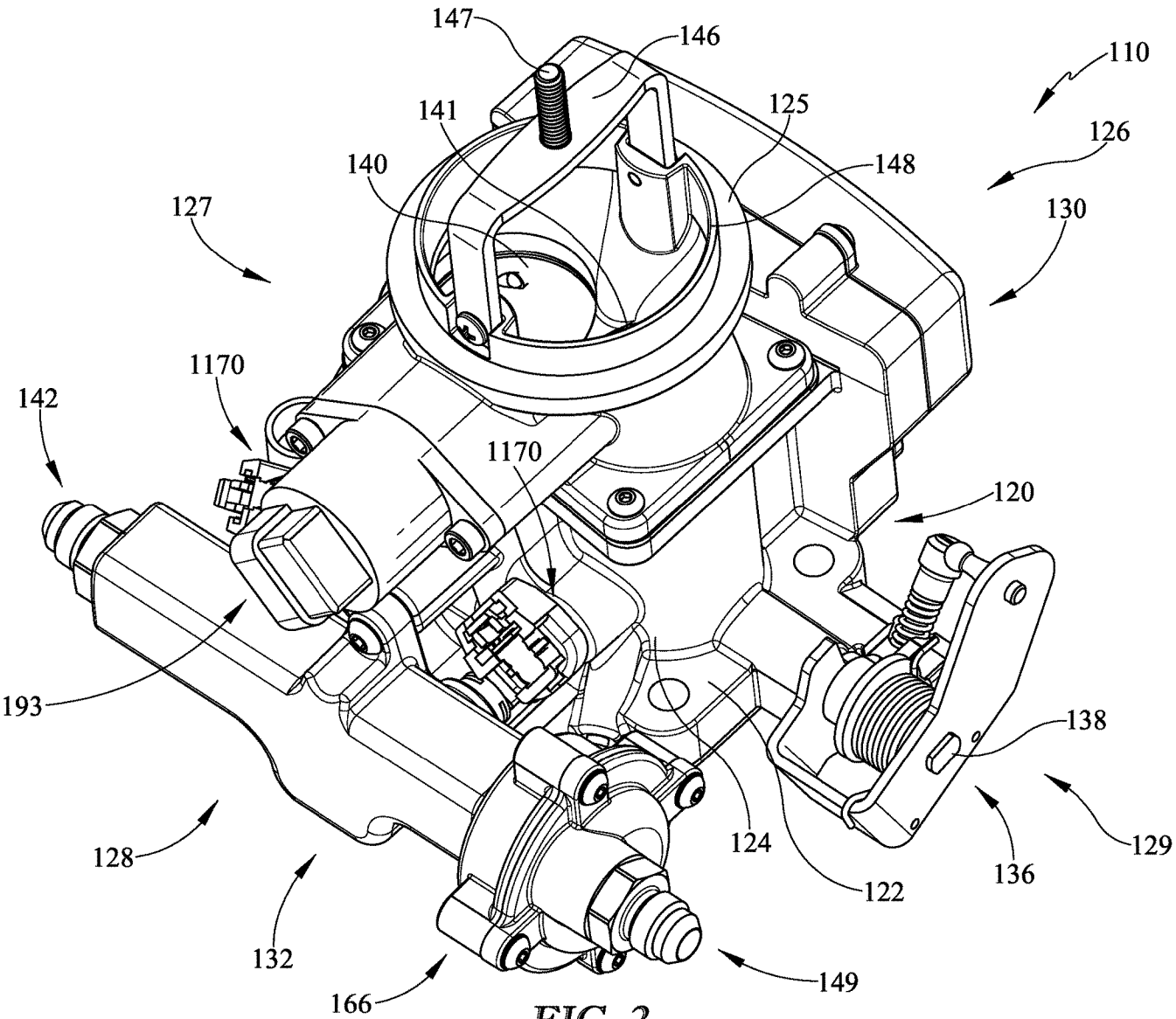
FIG. 2 is a first perspective view of the electronic fuel injection throttle body assembly.

With reference to FIG. 2, a first upper perspective view of the throttle body assembly 110 is illustrated. The throttle body assembly 110 includes a throttle body 120 including a mounting base 122 and a main body 124 which extends upwardly from the base 122. A stand 146, or air filter mount, is provided between the bores 140, 141 which supports a fastener 147 extending through the throttle body 120. The fastener 147 extends up for engagement and connection of the air filter 112 (FIG. 1). Although a specific structure is shown and described, other arrangements may be provided which support an air cleaner in a variety of manners.

The upper end of the main body 124 may include an upper flange 125. This may define a seat or upper limit for positioning of air intake structure above the throttle body assembly 110. The base 122 may have a plurality of holes for mounting the assembly 110 wherein the multiple holes provide various known bolt patterns. For example, in some embodiments, four screws may be used to mount the base 122, however, this is not intended to be limiting as any number of bolt patterns may be used. The base 122 may also include various pipe ports where for example some vehicle engines require vacuum ports. For example, a manifold vacuum port, distributor spark and other may be provided along, or near the base 122 and on the throttle body 120. The ports may be plugged at time of manufacture and unplugged by the end user to make these ports functional.

The depicted embodiment provides an inlet 148 defined by a wall extending from the flange 125 and forming a cavity therein. The inlet 148 is circular but may be alternate shapes. Further however, it may be desirable to provide a shape which does not adversely affect air flow moving through this area. The inlet 148 receives air from an air cleaner, such as an air filter 112 (FIG. 1), and directs the air into the throttle body 120.

Figure 7:
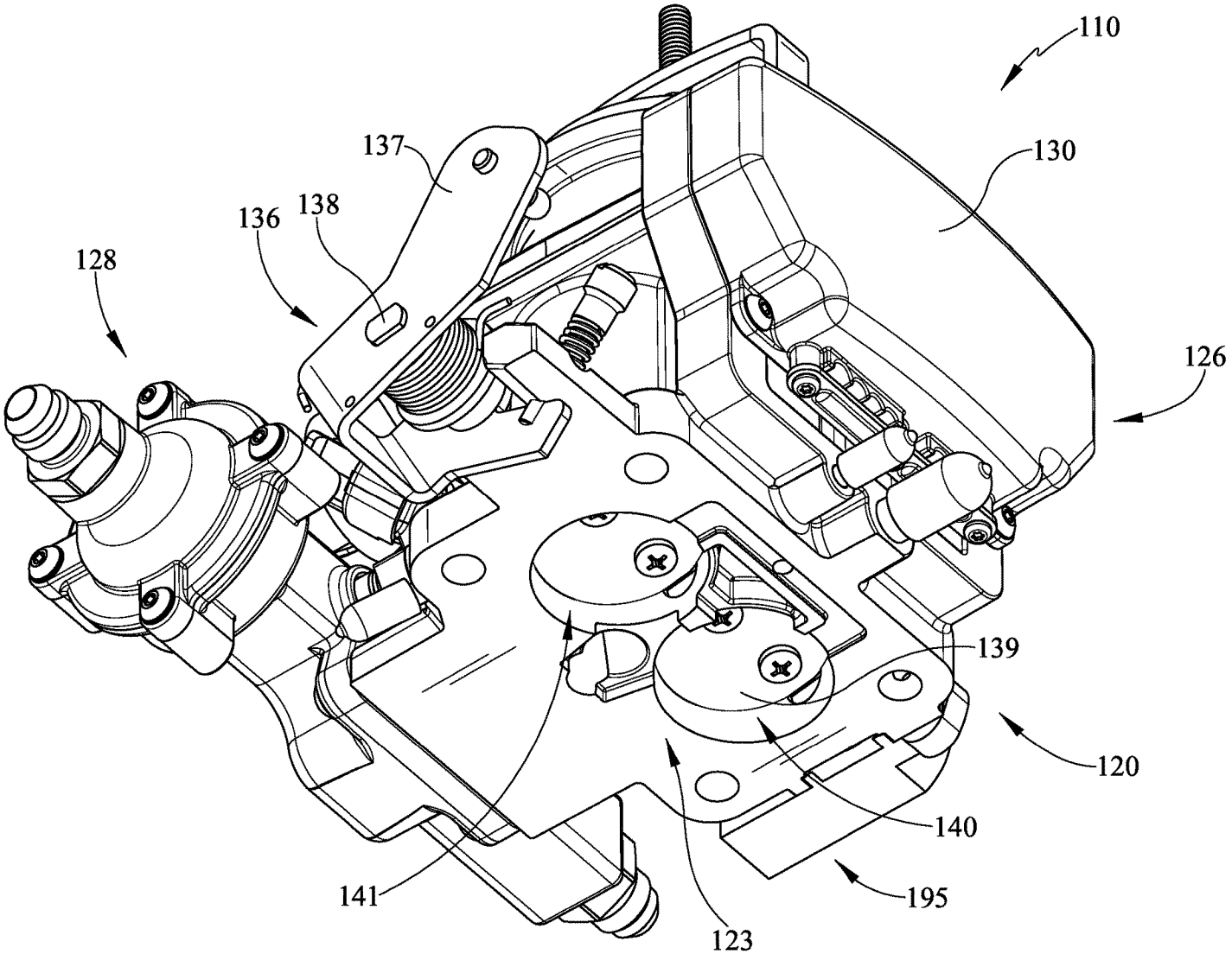
FIG. 7 is a lower perspective view of the electronic fuel injection throttle body assembly.

The inlet 148 expands into two bores or barrels 140, 141. The bores 140, 141 extend downwardly through the throttle body 120 toward a bore outlet 123 (FIG. 7). Further, while a single inlet 148 is shown, additional inlets may be used wherein each inlet 148 expands into two or more bores and barrels.

Also shown on the outside of the throttle body assembly 110 is a throttle lever assembly 136. The throttle lever assembly 136 is connected by linkage, such as a cable, in order to rotate a throttle shaft 138.

On one side of the throttle body 120, a fuel component cover 132 is disposed. The fuel component cover 132 provides a cover for a fuel pathway and define the fuel passageway therein, which will be described in greater detail herein. The component cover 132 functions to distribute fuel received to at least one fuel injector. The fuel component cover 132 receives fuel at an inlet 142 and directs fuel through the fuel injectors before the fuel exits the throttle body assembly at an outlet 149. The fuel component cover 132 is removably fastened to the throttle body 120. Again, the sides may differ in mounting position in other embodiments. Further, the inlet 142 and outlet 149 are shown at ends but may be at other positions.

Disposed between the fuel component cover 132 and the throttle body 120, are first and second fuel injectors 1170. Each injector 1170 corresponds to one of the bores 140, 141.

Additionally, an idle air controller (IAC) motor 193 and valve assembly is shown. The IAC motor 193 is shown extending from an upper end of the throttle body 120. The IAC motor 193 controls engine idle airflow condition via a stepper, or other, motor, and an attached valve which meters airflow to the engine manifold and is in communication with and controlled by, the engine control unit 190. Additionally, the IAC motor 193 is shown exteriorly of the fuel cover 132, but also may be disposed partially or fully within such fuel component cover 132. The IAC motor 193 is removable connected by fasteners, but alternatively may be permanently fixed to the throttle body. With brief reference to FIG. 9, a valve 194 is shown next extending from the motor 193 such that valve 194 moves to open or close airflow from near the inlet 148 and which is capable for flowing downward through a path 196 to a lower opening at the outlet end of the throttle body 120 and into the engine manifold.

The throttle body assembly 110 is shown in the instant view from a different angle than FIG. 1. For purpose of reference of description, but not limiting, a side 126 of the throttle body assembly 110 is shown and a side 128 generally on an opposite side from the first side 126. The first side 126 of the throttle body assembly 110 may include a cover 130. As will be described in further detail herein, the cover 130 conceals and contains an electronic control unit (ECU) 190 (FIG. 10), which may be mounted to the throttle body 120 or within the cover 130, or a combination thereof. This cover 130 may be bolted to the throttle body 120 or otherwise fastened thereto.

For purpose of general and brief explanation, as a driver wants to increase speed or power production of the combustion engine, the gas pedal is pressed, causing movement of the throttle lever assembly 136. When the lever moves, the throttle shaft also rotates opening the valve plates 139 (FIG. 8) within the bores 140, 141. As the valve plates 139 rotate, the airflow is increased into the throttle body 120. Additionally, the fuel moves through the inlet 142 and the fuel component cover 132. The injectors $\mathbf{1170}_x$ are in flow communication with the fuel component cover 132 on the one side, and with the bores 140, 141 on the second side. The subscript "x" indicates that more than one injector may be utilized. The fuel flow increases with the increased air flow when the throttle lever assembly 136 is actuated.

Figure 3:
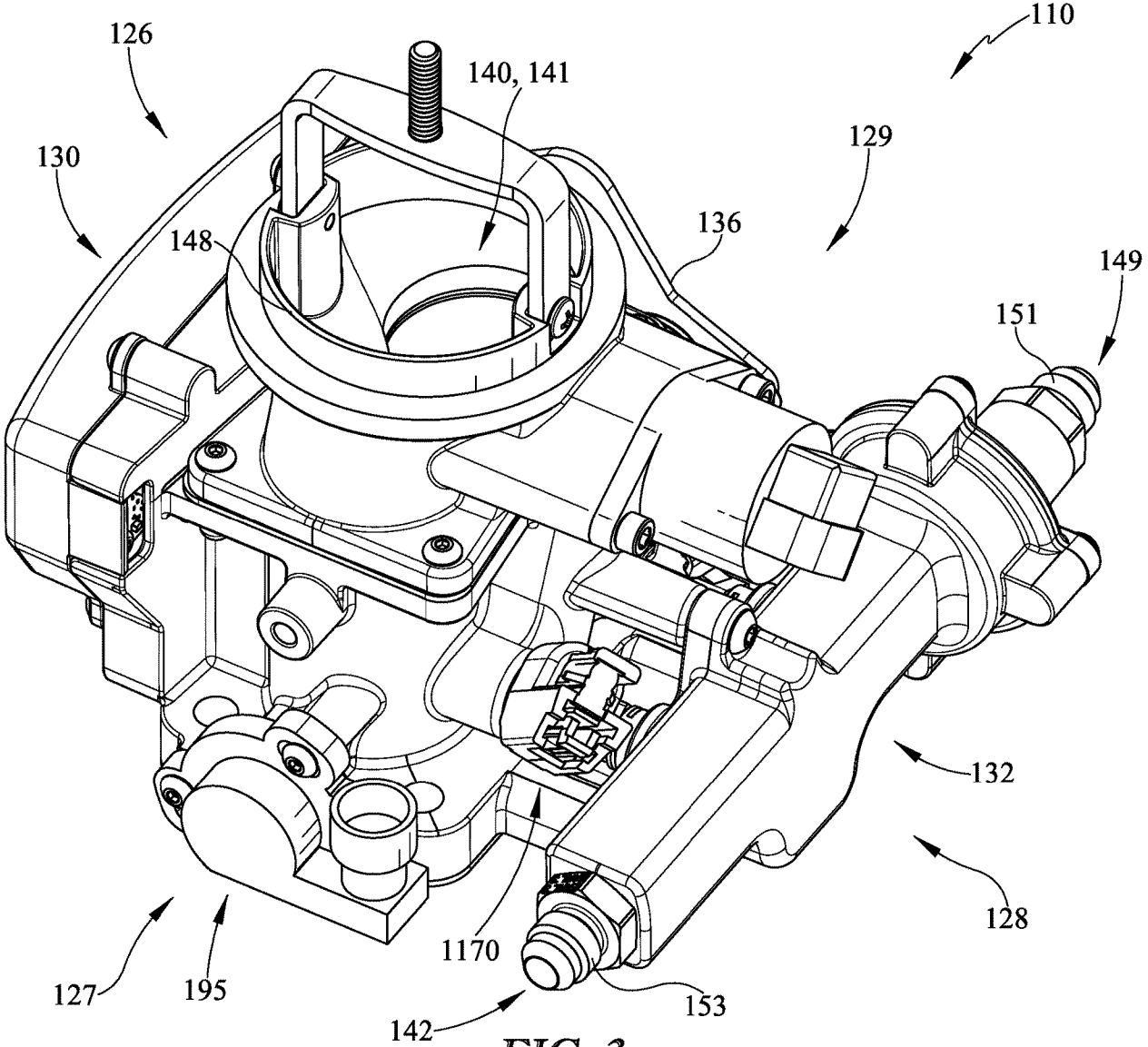
FIG. 3 is a second perspective view of the electronic fuel injection throttle body assembly.

With reference now to FIG. 3, a second perspective view of the throttle body assembly 110 is shown. From this view, the upper portion of the bore 141 is shown better. The fuel inlet 142 is also shown having a fitting 153. Air enters the inlet 148 and passes to the bores 140, 141. The area between the inlet 148 and the bores 140, 141 may be rounded or curved to provide smooth flow into the bores 140, 141.

Figure 8:
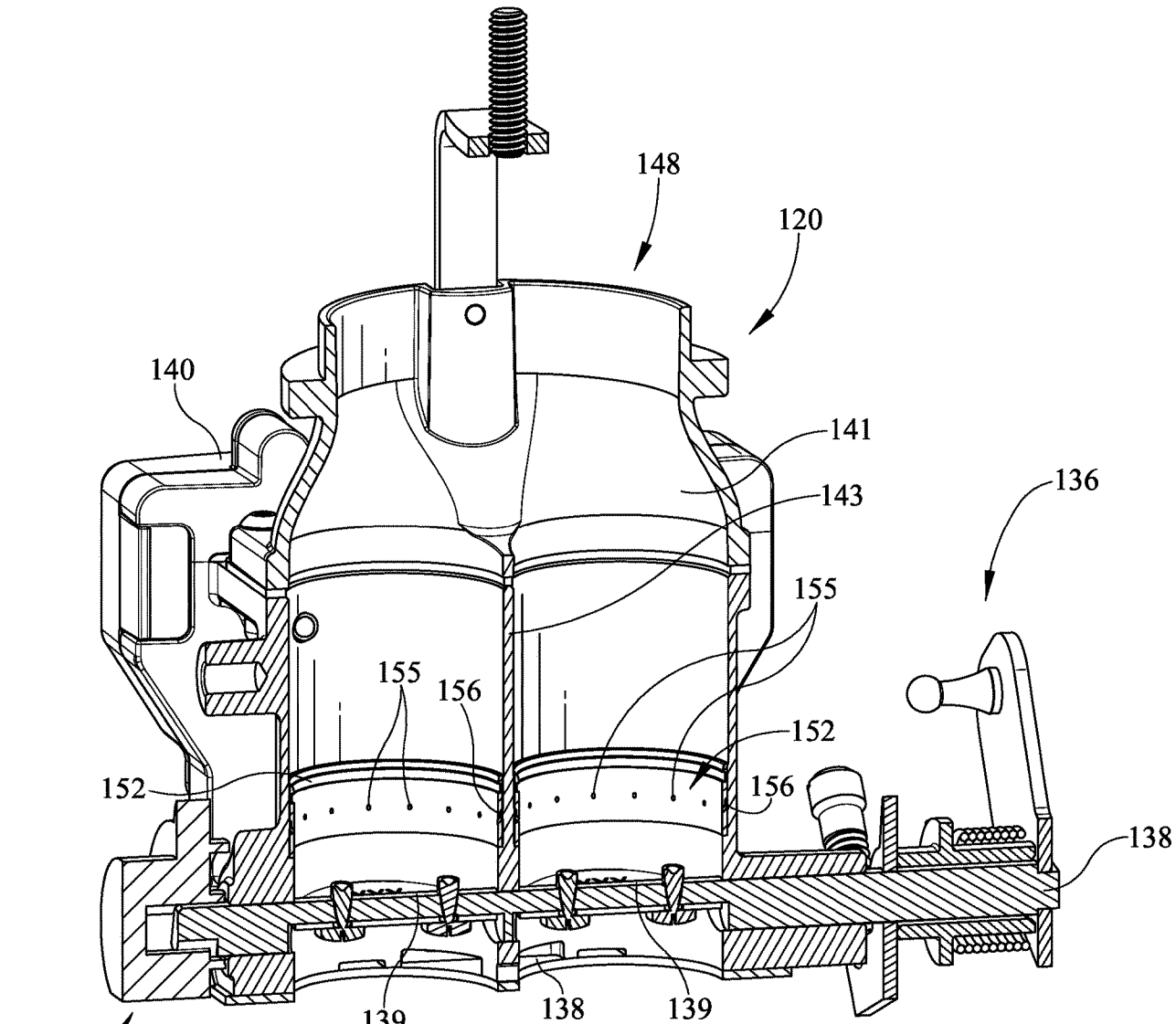
FIG. 8 is a section view through the throttle body depicting the inlet and the first and second bores.

At a second end of the fuel component cover 132. Fuel enters the inlet 142 and then passes through to the injectors 1170. Fuel is then injected in the bores 140, 141 via rings 152 (FIG. 8).

The throttle body 120 also comprises sides 127, 129 which are labeled for ease of reference in description. The throttle body sides 127, 129 include a throttle shaft position sensor 195 and the throttle lever assembly 136.

Positioned on a side of the throttle body assembly 110 opposite the throttle lever assembly 136 is the throttle position sensor 195. The position of the throttle shaft 138 (FIG. 2) is determined by the sensor 195 and may provide a signal back to the electronic control unit 190 (FIG. 9) of the throttle position.

Figure 9:
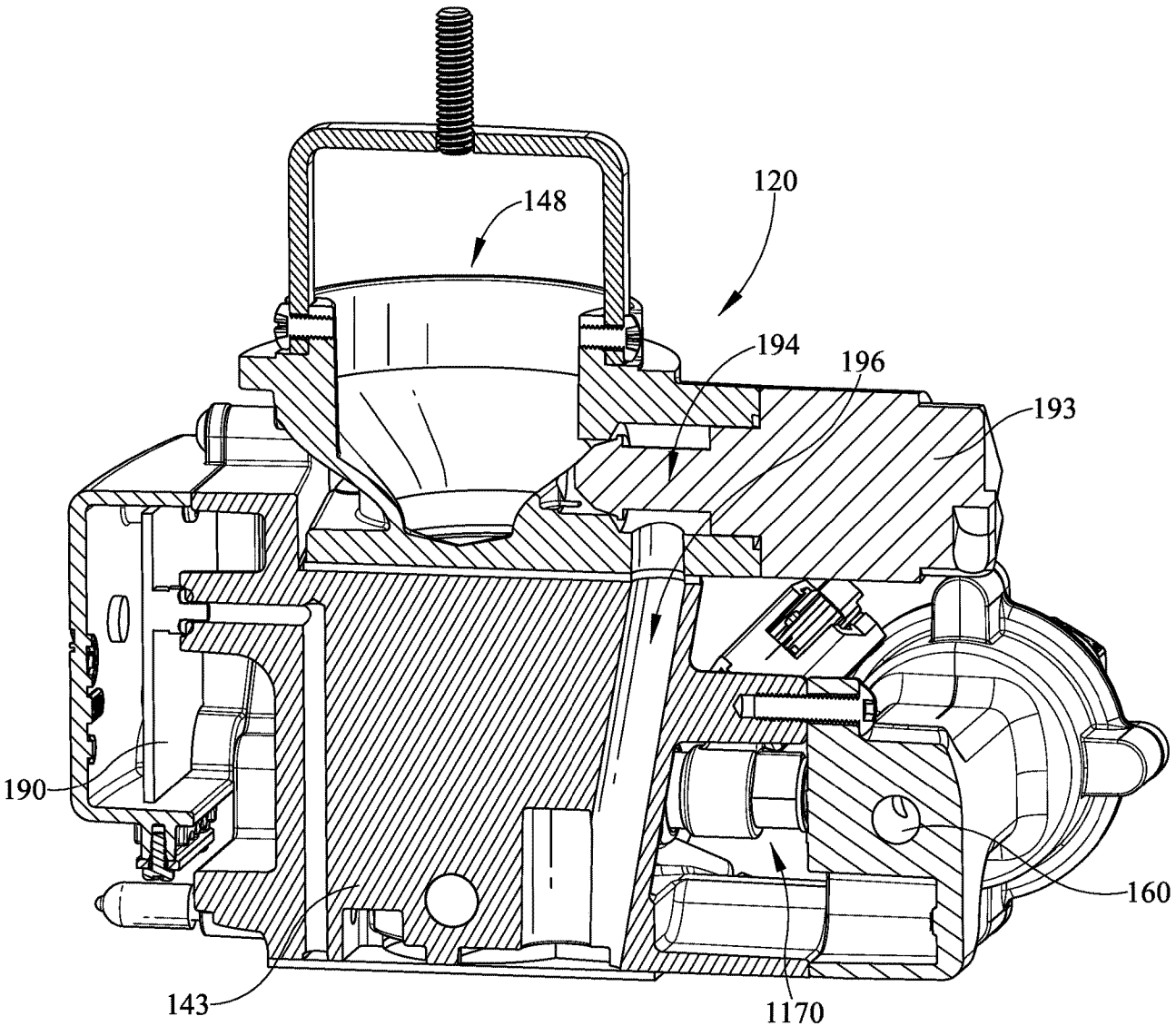
FIG. 9 is a section view taken at 90 degrees to the view of FIG. 8; and, FIG. 10 is a section view taken in a plane spaced from and parallel to that shown in FIG. 9.

With reference to both FIGS. 2 and 3, in addition to the fuel passage componentry in the component cover 132, the fuel injectors 1170*x* may be partially housed in the cover 132. The passageway within the cover 132 is in fluid communication with the fuel injectors 1170. With the electronic control unit cover 130 positioned on the side 126 of the throttle body assembly 110 adjacent to the component covers 132, the wire extending between the electronic control unit 190 (FIG. 9) and each of the fuel injectors 1170*x* may be substantially unexposed exteriorly or alternatively, any exposure may be limited. An electronic connector is located on each fuel injector 1170 which may provide either or both of power and control signals to each injector from the electronic control unit 190 (FIG. 9).

The fuel component cover 132 is also shown in FIG. 3. The fuel component cover 132 may comprise one or more inlet fittings 153 which may define one or more fuel inlets 142. In some embodiments, fitting 153 may be a standard fitting such as an SAE, ASME or similar automotive fitting for ease of use and/or replacement.

Figure 5:
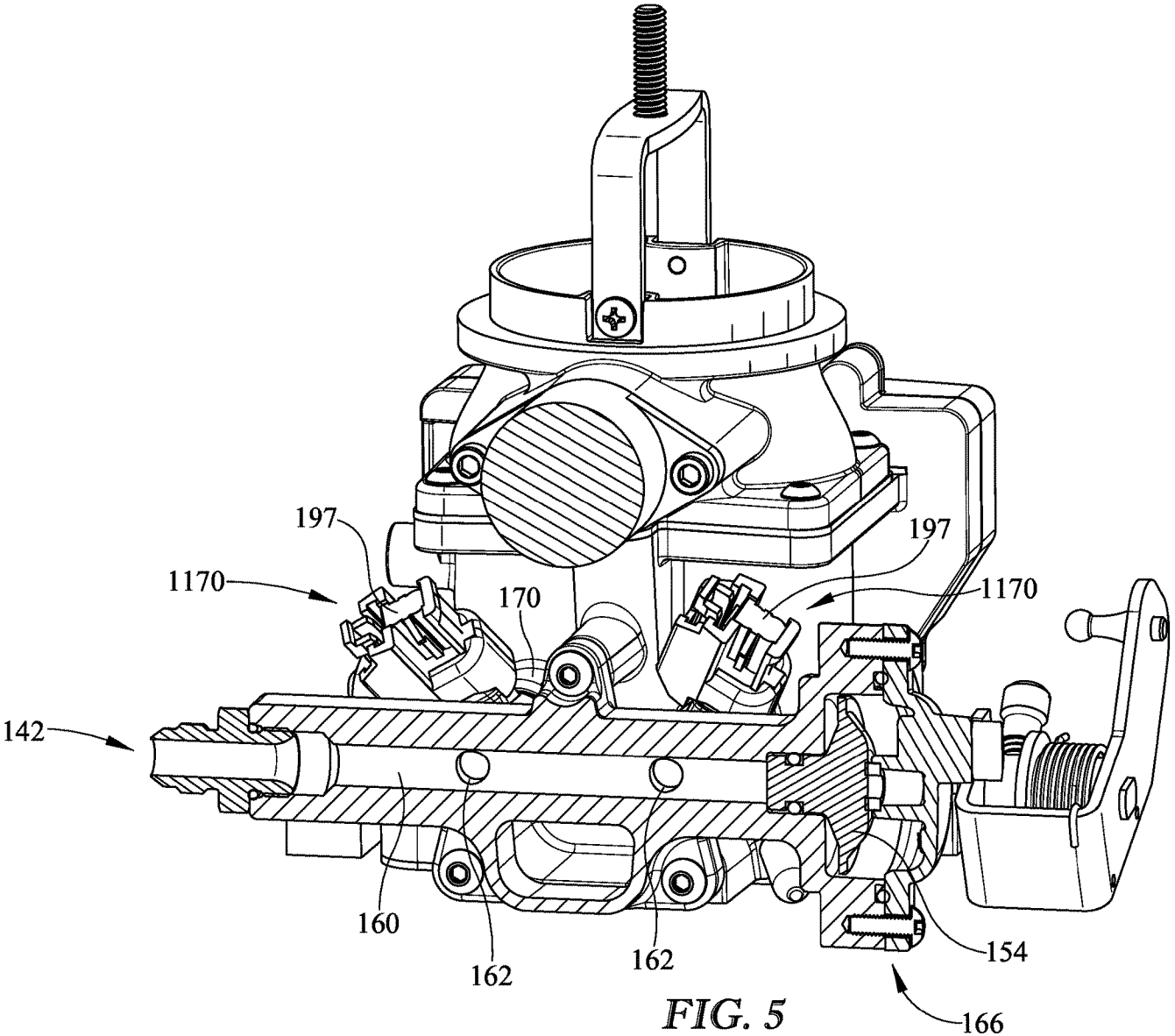
FIG. 5 is a section view of the fuel component cover depicting the fuel passage therethrough.

In some embodiments, each fuel component cover 132 may include a connecting fuel passage 160 (FIG. 5). These fuel passages 160 may be oriented substantially horizontally and extends between the inlet 142 and the outlet 149 ends of the cover 132.

Figure 4:
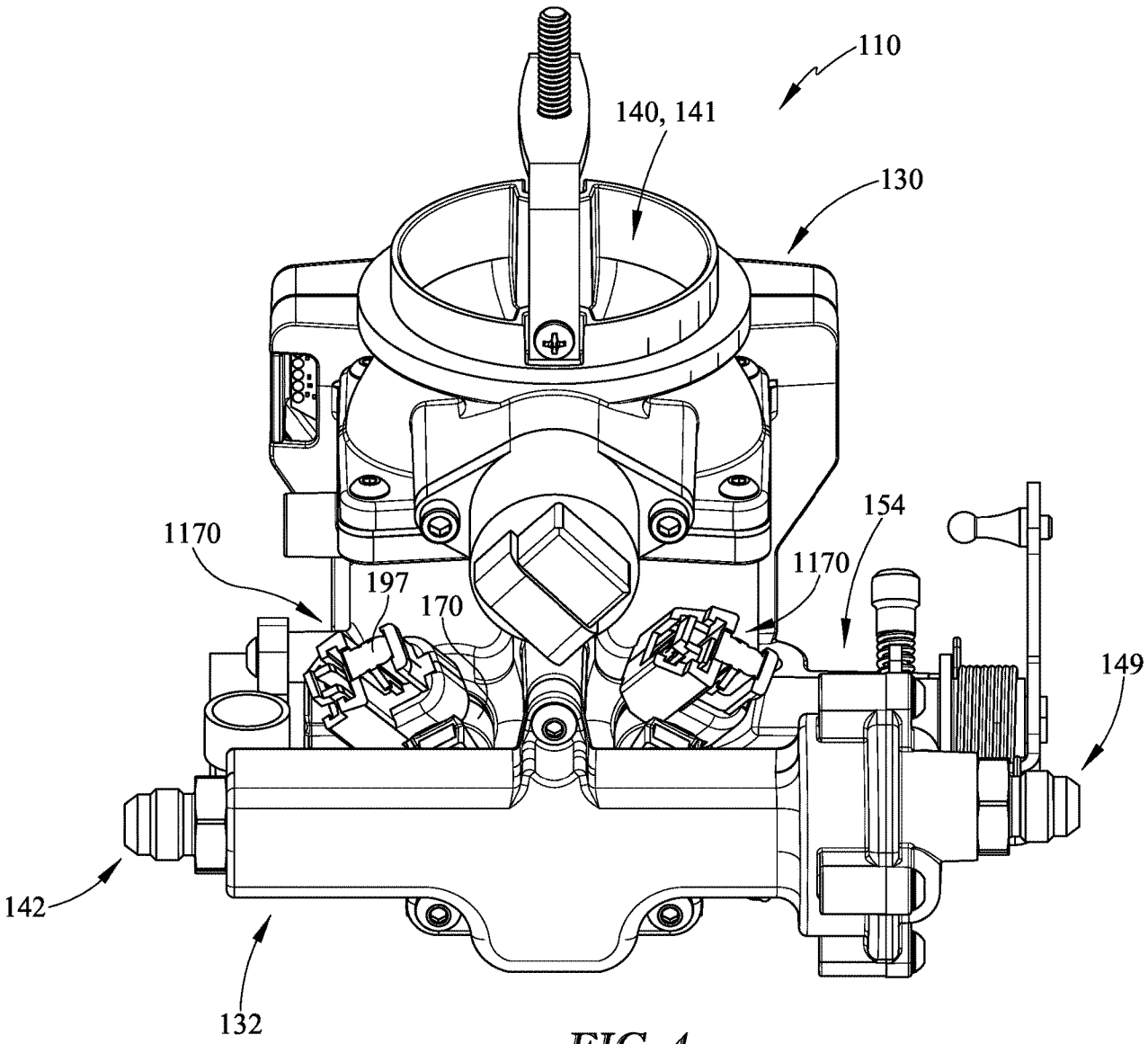
FIG. 4 is a view of a fuel component cover mounted on said throttle body.

With reference now to FIG. 4, a perspective view of the fuel component cover 132 is depicted. The fuel component cover 132 is positioned adjacent to the fuel injectors 1170. The fuel component cover 132 receives fuel at the inlet 142 and directs fuel through a passage or fuel passage 160 (FIG. 5) within the fuel component cover 132. Between the inlet 142 and the outlet 149, the fuel passage 160 is also in flow communication with the injectors 1170*x*. In operation, the fuel flows to the injectors 1170*x* and to a regulator 154 wherein pressure builds. Once fuel is moving through the injectors 1170*x* and pressure reaches a preselected value, the regulator 154 will open and allow flow back to a fuel tank or other location.

With additional reference to FIG. 5, a section view of the fuel component cover 132 (FIG. 4) is provided. In this view, the fuel passageway 160 is shown extending between the inlet 142 and the outlet 149. The inlet and outlet 142, 149 may be machined into the fuel component cover 132. Further the fuel passageway 160 may also be machined. Other ways of forming these structures may also be utilized, such as by casting, molding or other manufacturing techniques. Also depicted within the fuel passage 160 are ports or openings 162 which provide fuel communication from the passage 160 to the fuel injectors 1170*x*. The injectors 1170*x* extend between the fuel component cover 132 and the main body 124 (FIG. 2).

Disposed above the fuel component cover 132 in the views of FIGS. 4, 5 are the connectors 197 for the fuel injectors 1170*x*. The connectors 197 are electrically connected to the electronic control unit 190 (FIG. 9). The connectors 197 connect to, and provide electrical communication with, the injectors 1170*x* to provide control signals. Through this wired connection with the electronic control unit 190, the injectors 1170*x* may be directed to inject fuel by the ECU 190.

Referring still to FIGS. 4, 5 the pressure regulator 154 is shown. This pressure regulator 154 can be set to allow fuel to flow from the outlet of the component cover 132 when the fuel pressure reaches a certain level. The setting may be done at time of manufacture or may be adjustable. A fitting 151 is also shown in fluid communication with the regulator 154 to allow conduit connection for fluid flow return to the fuel tank. One skilled in the art will appreciate that the regulator 154 may have one or more parts that open and close flow to the port, based on pressure within the fuel passages of the throttle body assembly 110.

The regulator 154 is housed in a regulator cover 166 and is shown connected to a portion of the fuel component cover 132. The regulator cover 166 may be formed with the fuel component cover 132 or may be a separate structure. The regulator cover 166 provides for a fuel outlet 149 and fitting 151 through which fuel returns to a fuel tank of the vehicle. The regulator cover 166 is formed with the fuel component cover 132, which protects the regulator 154 (FIG. 5) therein but also provides for ease of installation and manufacturing, in that once the fuel component cover 132 is installed, the regulator 154 is in place and ready for connection with return line to the fuel tank. In other embodiments, however, the cover 166 may be formed separate of the cover 132 and may be attached for fluid connection of the regulator 154 therein.

Also as shown in the end view, the outlet fitting 151 may be positioned off-center relative to the regulator cover 166 (see also FIG. 2). The regulator cover 166 may be clockable, or rotatable, in 90 degrees increments to rotate the position of the outlet fitting 151. The regulator cover 166 may comprise one or more fasteners which may be removed and reinstalled to rotate the regulator cover 166 into a position wherein the outlet fitting 151 does not interfere with other parts. Thus, depending on the surrounding equipment in the engine, the fitting or port 151 position may be altered so as to limit interference or otherwise increase clearance relative to either or both of the engine compartment or other engine components.

Additionally, according to some embodiments, the regulator 154 may be removable. This may be desirable if for example the regulator operates at a fixed, preselected value, but an end user would like a different operating pressure. In order to do so, the regulator cover 166 may be removed and the regulator 154 may also be removed from inside the component cover 132. As a result, when the regulator 154 is removed, an alternate external regulator may be utilized and placed in fluid communication, direct or indirect, with the outlet 149. Further, no other plugs, fittings or other plumbing hardware is needed within the fuel component cover 132. In other embodiments, a returnless fuel arrangement may be formed wherein a plug may be utilized at the outlet side 149 of the cover 132 and the fuel is forced through the injectors without a return path to the fuel tank. In still other embodiments the fuel flow direction may be reversed, wherein fuel is delivered to the outlet side of the cover 132 and out through the inlet side 142. In such arrangement, the regulator 154 may need to be removed from the flow path in its depicted position.

Figure 6:
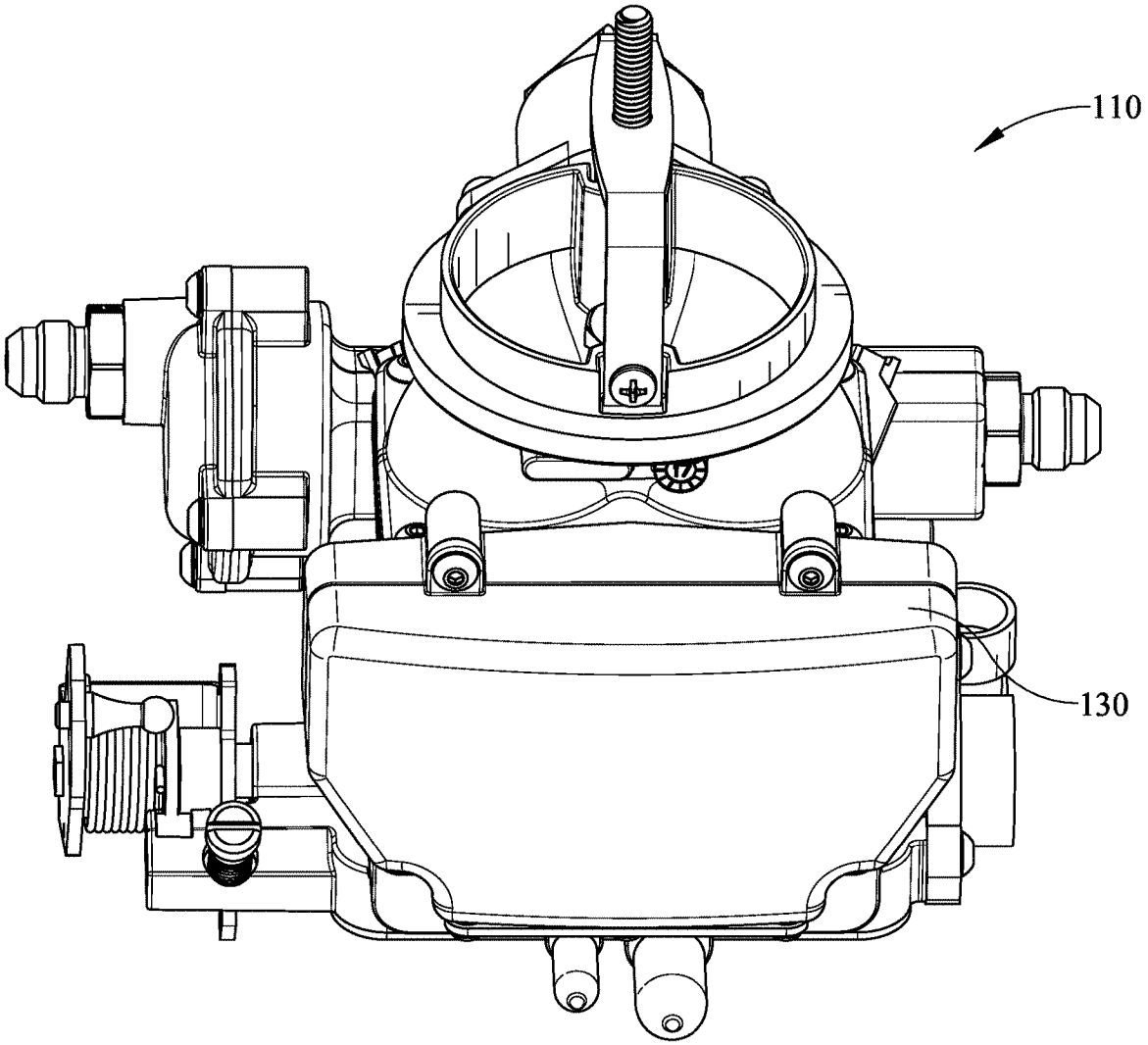
FIG. 6 is a view of an electronic control unit cover disposed on the throttle body.

Referring now to FIG. 6, a perspective view of the electronic fuel injection throttle body assembly 110. In this view, the electronic control unit (ECU) cover 130 is shown. The ECU cover 130 is removable connected to the main body 124. With additional reference to FIGS. 9 and 10, the interior of the electronic control unit 190 is shown within the ECU cover 130. The cover 130 is connected to the throttle body 120, for example by fasteners or otherwise removably connected. The electronic control unit 190 may be a printed circuit board, and may further comprise memory to which operating code may be flashed. The electronic control unit 190 may be connected to the cover 130 for example by one or more fasteners and may also be potted to reduce effects of contaminants, water, noise, vibration or other environmental influences. Alternatively, the electronic control unit 190 may be connected to the throttle body 120 and then covered by the cover 130. The electronic control unit 190 or "controller" is used herein generally to describe various apparatus relating to the monitoring of engine data, user input and the performance of one or more actions in response to occurrence of certain engine sensor data or action from user. A controller can be implemented in numerous ways (e.g., such as with dedicated hardware) to perform various functions discussed herein. A "processor" is one example of a controller which employs one or more microprocessors that may be programmed using software (e.g., microcode) to perform various functions discussed herein. A controller may also include a printed circuit board and may be implemented with or without employing a processor, and also may be implemented as a combination of dedicated hardware to perform some functions and a processor (e.g., one or more programmed microprocessors and associated circuitry) to perform other functions. Examples of controller components that may be employed in various implementations include, but are not limited to, conventional microprocessors, application specific integrated circuits (ASICs), and field-programmable gate arrays (FPGAs).

In various implementations, a processor or controller may be associated with one or more storage media (generically referred to herein as "memory" e.g., volatile and non-volatile computer memory such as RAM, PROM, EPROM, and EEPROM, floppy disks, compact disks, optical disks, magnetic tape, etc.). In some implementations, the memory may be encoded with one or more programs that, when executed by the controller, perform at least some of the functions discussed herein. Memory may be fixed within a processor or controller or may be transportable, such that the one or more programs stored thereon can be loaded into a processor or controller so as to implement various aspects of implementations disclosed herein.

The ECU 190 may also have integrated into its circuitry a Manifold Absolute Pressure (MAP) sensor and/or Intake Air Temperature (IAT) sensor. Both the MAP and IAT sensors provide feedback to the ECU 190 on environmental conditions that effect the fuel requirements of the engine for proper combustion of the air/fuel mixture. For example, the MAP sensor monitors the absolute air pressure below the throttle valve plates at the engine manifold and the IAT sensor monitors the temperature of the air entering the bores 140, 141.

Referring now to FIG. 7, a lower perspective view of the throttle body assembly 110 is depicted. The throttle lever assembly 136 may be positioned on side 128 of the throttle body assembly 110. The throttle lever assembly 136 comprises a throttle shaft 138 extending through the throttle body 120 and bores 140, 141. The throttle shaft 138 may extend in a direction perpendicular to a horizontal direction between a first end and a second end of the fuel injectors 1170*x*. At the opposite side of the throttle body 120 (e.g. side 126) from the lever assembly 136 and connected to the throttle lever assembly 136 may be the throttle position sensor 195 which provides communication to the electronic control unit 190, concealed by the cover 130.

Also shown in the lower view is the throttle lever assembly 136, which includes throttle lever 137 and a throttle shaft 138 extending through the bores 140 and valves or valve plates 139. The lever assembly 136 causes opening or closing of the valve or valve plates 139 by rotating the shaft 138. The shaft 138 may be connected above or below the valve plates 139. As the valve plates 139 open and close, the amount of fuel-air mixture delivered to the engine may be varied and controlled. When the valve plates 139 are open, more fuel-air mixture may be delivered and, by contrast, when closed, the amount of fuel air mixture delivered to the engine decreases.

The throttle lever 137 is provided which rotates when connected to a throttle linkage. The throttle lever 137 may be connected to a gas pedal mechanically to move based upon driver input by the mechanical linkage, including a cable. Thus when the gas pedal is depressed, the lever 137 moves to rotate shaft 138 and open the plates 139. Alternatively, as the pedal is released, the spring force causes rotation toward a closed position of the throttle plates 139.

The lower view also provides view of the bores 140, 141. The bores 140, 141 extend from an inlet on the upper side of the throttle body 120 through a lower surface thereof. The bores 140, 141 provide mixing of air and fuel and allow direction of the fuel air mixture from the exit or outlet lower end of the throttle body 120.

Referring now to FIG. 8, a section view of the throttle body 120 is shown. The throttle body 120 has the inlet 148 at the upper end. The inlet 148 expands to provide spacing for the two bores 140, 141. The inlet 148 may be divided evenly as shown or may be divided unevenly, wherein one opening into the bores 140,141 is larger than the other. The bores 140, 141 may also be sized the same or may be of differing sizes.

Also depicted within the bores are the plates 139 and shaft 138 of the throttle lever assembly 136. With the section view, the interior of the bores 140, 141 also reveal the fuel distribution rings 152. The ring or sleeve 152 is generally cylindrical in shape and has hollowed interior with open axial ends. Each of the rings 152 have a plurality of apertures 155 through which the fuel passes into the bores 140, 141. The fuel injectors 1170*x* (FIG. 5) deliver fuel to a channel 156 extending about the outer circumference of the rings 152 and in flow communication with the apertures 155 on the inner surface of the rings 152. The fuel then moves through the apertures 155 into the bore. The ring or sleeve 152 in combination with the inner diameter of the bores 140, 141 may form the channel around which the wherein fuel passes circumferentially to the plurality of apertures 155 located in the rings 152. The fuel exiting through the apertures 155 mixes with air passing through the bores 140, 141.

Referring now to FIG. 9, the throttle body 120 is again shown in a section view. The section is taken in a direction which is spaced circumferentially from the section shown in FIG. 8. The section view is taken through a dividing wall 143 which separates the bores 140, 141. The dividing wall 143 is shown extending from the top of the bores 140, 141 near inlet 148 to the bottom or outlet of the throttle body 120. The dividing wall 143 maintains flow separation between the two bores 140, 141 once air passes through the inlet 148 and moves toward the outlet of the throttle body 120.

Figure 10:
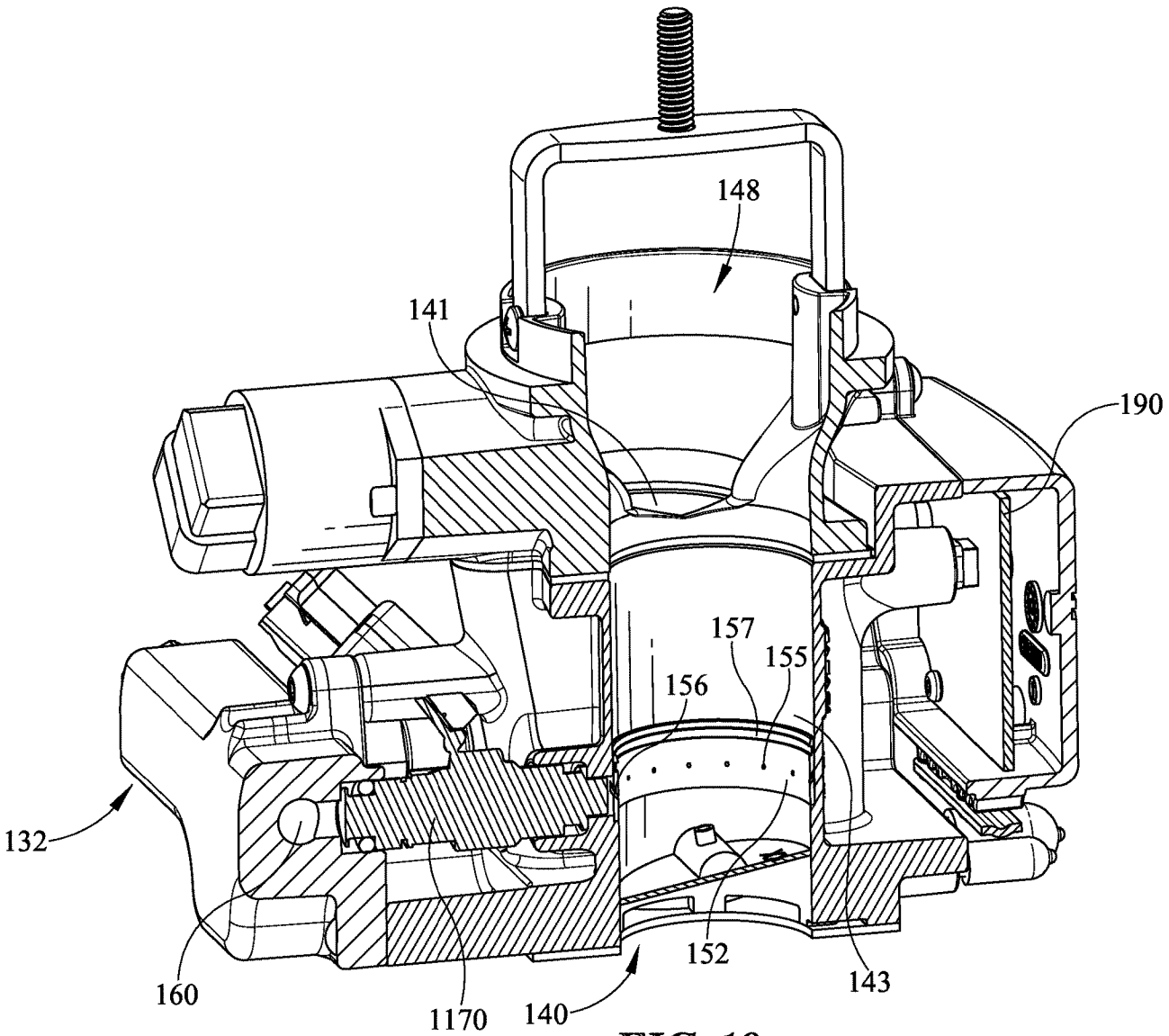

Referring now to FIG. 10, a further section view is provided in similar orientation as FIG. 9, but closer to the viewer. In this view, portions of both bores 140, 141 are shown, rather than just a single bore. In this view, the inlet 148 expands in directions toward and away from the viewer, but contracts downwardly toward the dividing wall 143 in a perpendicular (right-left) direction, as shown. Thus, when air flow moves downwardly through the inlet 148, the single inlet expands to define the two bores 140, 141, but contracts between the bores to form the dividing wall 143

Also shown in this view is a section taken through the fuel injectors 1170*x*. The flow passage 160 is shown within the fuel component cover 132. One injector 1170 is shown in flow communication with the passage 160 at a first end of the injector 1170. At a second end of the injector 1170, the interface between the injector 1170 and the bore 140 is shown. The fuel is directed in a channel extending about the ring 152 and through the apertures 155. This arrangement is also provided for bore 141.

With reference additionally to FIGS. 8 and 10, the rings 152 are shown in the bore 140. The ring 152 includes a channel 156 which extends circularly about the ring periphery at an elevation adjacent to the location of the injectors 1170. Also adjacent to the channel 156 are a plurality of the fuel apertures 155 which deliver fuel into the inner surface of the ring 152 and into the interior of the bore 140, radially inward of the ring 152. The apertures 155 direct fuel downward and in a radial direction into the center of the ring 152 and bore 140. In other embodiments, the apertures 155 may have centerlines which direct fuel at an angle to a radial direction, wherein the angle may be within to a horizontal plane or a vertical plane or both.

Also shown within the ring 152 is a groove 157 which may be used to move the ring 152 during installation. A tool may be inserted from one end of the bore 140 and expanded to engage an edge of the groove 157. Once engaged, the ring 152 may be forced upwardly, for example, or downward out of the bore, depending on the entrance direction of the tool.

As noted previously, the embodiment of FIGS. 9, 10 depict a single row of fuel injectors 1170. Accordingly, there is a single row of apertures 155 in the ring 152. However, as also mentioned, some embodiments may include a second row of injectors in a second upper configuration. That is, each bore 140 may have two vertically arranged injectors and ports 170, 171 for example. The plurality of these upper injectors may be considered an upper row within the throttle body 120. Accordingly, a second row of apertures may be found on some rings.

With reference again to FIG. 10, one injector 1170 is shown extending into the bore 141. The injector 1170 is shown schematically as it is cross-hatched and the flow path therein is not shown. The instant embodiment is provided with a single fuel injectors per bore. The fuel injectors 1170 may be utilized based on size of the engine and/or performance requirements. Where additional performance is desired additional fuel injectors may be used in each bore. When larger engines are utilized and higher horsepower is required for example, more fuel injectors 1170 may be desirable. For example, additional fuel injectors 1170 may be stacked or arranged in a vertical direction, above those which are shown. Practically speaking, and merely for non-limiting example, the throttle body 120 may be cast for example with two ports per bore 140, 141, in the stacked vertical arrangement. During subsequent manufacturing, depending on the need for one injector or two injectors per bore, the additional injector port may be machined to accept an injector. Alternatively, rather than not machining all of the cast ports of each bore, all of the ports could be machined but the unused ports could be closed with a plug. Therefore, at some point in the future, an end user or a manufacturer could subsequently unplug any plugged ports for use of additional fuel injectors.

As illustrated in the embodiments discussed herein, the fuel injectors $\mathbf{1170}_x$ may be oriented such that they are parallel to the base 122 of the throttle body assembly or may be oriented in an angled (for example downward) direction into the bore(s) 140.

In embodiments with only one fuel injector per bore, there may be only a single row of apertures 155 in the ring 152. However, in embodiments with two fuel injectors per bore there may be a second row of apertures 155 found on some rings 152 or alternatively multiple rings may be used each with a single row of apertures 155. In still other embodiments a single channel with enough height may also deliver fuel to apertures in various configurations including one or more rows.

The ring 152 may be formed in the shape of a substantially cylindrically shaped inner wall or may alternatively have a venture shape. The upper ends of the rings 152 may also have a slight taper along at least the outer surface to improve sealing of the rings within the bores 140. Further, the height of the rings 152 may also be shorter than the length of the bores 140.

With this in mind, it may be desirable to provide modular features for the throttle body assembly to meet any number or combination of these desired characteristics and/or applications. For example, the position and number of fuel injectors may vary. As described previously, various number of injector ports may be cast or formed, but not all used in each application. Furthermore, the throttle body assembly may also be scaled smaller, using fewer than two bores (for example, one bore).

Interchangeability of components also lends itself in the multiple assembly application side by side on an existing intake manifold. For example, in multi-throttle body applications, one intake manifold may feed one engine.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the invent of embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teaching(s) is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms. The indefinite articles "a" and "an," as used herein in the specification and in the claims, unless clearly indicated to the contrary, should be understood to mean "at least one." The phrase "and/or," as used herein in the specification and in the claims, should be understood to mean "either or both" of the elements so conjoined, i.e., elements that are conjunctively present in some cases and disjunctively present in other cases.

Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

The foregoing description of methods and embodiments of the invention has been presented for purposes of illustration. It is not intended to be exhaustive or to limit the claims to the precise steps and/or forms disclosed, and obviously many modifications and variations are possible in light of the above teaching. It is intended that the scope of the embodiments and all equivalents be defined by the claims appended hereto.

What is claimed is:

1. An electronic fuel injection throttle body assembly, comprising:

a throttle body having an upper inlet and a lower outlet configured to mount to an internal combustion engine;

said upper inlet having a single cavity which opens in an expanding direction into two bores extending through said throttle body;

said bores together defining said lower outlet;

a fuel component cover located on a first side of said throttle body and an electronic control unit cover located on a second side of said throttle body;

a first fuel injector and a second fuel injector disposed at least partially within said throttle body, wherein said first and second fuel injectors are parallel to a mounting base of said throttle body;

said fuel component cover connected to said throttle body and having at least one fuel passage in fluid communication with said first and second fuel injectors;

said fuel passage extending from a fuel inlet of said fuel component cover, said fuel passage extending parallel to said expanding direction;

a throttle shaft extending through said first and second bores of said throttle body, wherein said throttle shaft is perpendicular to a horizontal direction between a first end and a second end of each of said first and second fuel injectors, said throttle shaft extending in said expanding direction; and said first and second fuel injectors directing fuel into a channel of respective fuel distribution rings, each of said fuel distribution rings having a plurality of fuel apertures directing fuel into each of said bores of said throttle body.

2. The electronic fuel injection throttle body assembly of claim 1, wherein said upper inlet expands from a first size to a larger second size where said bores are positioned.

3. The electronic fuel injection throttle body assembly of claim 2 further comprising a wall in said single cavity dividing said first and second bores.

4. The electronic fuel injection throttle body assembly of claim 3, wherein said wall is either centered or un-centered within said single cavity.

5. The electronic fuel injection throttle body assembly of claim 4 wherein said bores are of a same diameter.

6. The electronic fuel injection throttle body assembly of claim 4 wherein said bores are of differing diameter.

7. The electronic fuel injection throttle body assembly of claim 1 further comprising an air filter mount extending from near said upper inlet.

8. The electronic fuel injection throttle body assembly of claim 1 further comprising a throttle lever connected to said throttle shaft.

9. The electronic fuel injection throttle body assembly of claim 8 wherein movement of said throttle lever opens at least one valve plate within each of said bores.

10. The electronic fuel injection throttle body assembly of claim 1, said electronic control unit cover disposed on an opposite side from said fuel component cover.

11. The electronic fuel injection throttle body assembly of claim 1 wherein said fuel component cover includes an inlet and an outlet.

12. The electronic fuel injection throttle body assembly of claim 11, further comprising a pressure regulator on said fuel component cover.

13. The electronic fuel injection throttle body assembly of claim 1, further comprising an electronic control unit in electrical communication with said first and second fuel injectors.

14. The electronic fuel injection throttle body assembly of claim 1, wherein said first and second fuel injectors are disposed between said fuel component cover and said throttle body.

15. The electronic fuel injection throttle body assembly of claim 14, said first and second fuel injectors in fluid communication with respective of said fuel distribution rings on an interior of each of said bores.

16. A method of delivering fuel and air to a combustion engine manifold, comprising:

pumping fuel to an inlet of an electronic fuel injection throttle body, said inlet expanding into a first bore and a second bore that extend through said electronic fuel injection throttle body to an outlet;

moving said fuel through a fuel component cover through a fuel passage in communication with first and second fuel injectors;

injecting fuel through said first and second fuel injectors into respective first and second bores;

directing airflow through a single inlet of the said throttle body, wherein said expands into said first bore and said second bore;

directing airflow through said first and second bores in flow communication with said single inlet; and, mixing said airflow and said fuel within said first and second bores.

* * * * *